United States Patent [19]

Jaunin

[11] 4,164,844

[45] Aug. 21, 1979

[54] TIMEPIECE DISPLAY INDICATOR

[75] Inventor: Jean-Pierre Jaunin, Nidau, Switzerland

[73] Assignee: Societe Suisse pour l'Industrie Horlogere Management Services S.A., Switzerland

[21] Appl. No.: 815,398

[22] Filed: Jul. 13, 1977

[51] Int. Cl.[2] ..... G04F 8/00; G04F 7/04

[52] U.S. Cl. ..... 58/39.5; 58/74

[58] Field of Search ..... 58/21.13, 39.5, 74, 58/152 R, 22.7; 235/92 T; 324/186

[56] References Cited

U.S. PATENT DOCUMENTS 3,813,533 5/1974 Cone et al. ..... 58/152 R 3,992,871 11/1976 Numabe ..... 58/39.5

4,058,971 11/1977 Epperson ..... 58/39.5

*Primary Examiner*—Edith S. Jackmon

*Attorney, Agent, or Firm*—Griffin, Branigan and Butler

[57] ABSTRACT

The invention concerns a solid state timepiece which provides chronograph functions and in which a single display unit is adapted to display either an elapsed time or the time of day. To distinguish when the chronograph function is being carried out within the timepiece signalling means is provided which may, for instance, take the form of an index symbol on the face of the display and indicates that the chronograph function is in operation even although the display may continue to display the normal time.

11 Claims, 2 Drawing Figures

TIMEPIECE DISPLAY INDICATOR

BACKGROUND OF THE INVENTION

It has already been proposed to provide a solid state timepiece with chronograph functions, both the timepiece and the chronograph output being displayable through a single digital type display which might, for example, be a liquid crystal type display or a light emitting diode display. With a single display unit, however, only one of the two functions may be displayed at any one time, thus if the time of day is being displayed and it should suddenly be required to engage the chronograph function it will normally be necessary to switch over the display to show the state of the chronograph prior to engaging the actual chronograph function. This may present certain disadvantages, as for instance, if one should be in a situation where an event is to be timed and the timepiece should be in the wrong display mode, several seconds may be lost whereby the result is falsified.

To overcome this problem the present invention proposes the use of an indicator in the form of signalling means which may be connected to the chronograph actuating switches and which may function when the chronograph is actually engaged whether or not the timepiece display is switched to show time of day or the chronograph mode. Thus, should the user be surprised by a situation, he need only engage the chronograph start switch and even though the timepiece continues to display the time of day the chronograph function will be engaged and this will be shown by a special signal which may, for example, take the form of a blinking light or other element similar to the display itself and which shows up regardless of which function is being displayed. Subsequently, on termination of the event to be timed when the chronograph has been stopped, but the registers are still filled the signalling means may, for example, provide a steady output. Finally, when the chronograph registers have been reset the indicator may be extinguished so that no further special effect is shown on the face of the display.

SUMMARY OF THE INVENTION

The invention accordingly comprises an electronic timepiece having control circuits arranged to drive a digital display so as to display selectively the passage of time (timepiece mode) or an interval of time (chronograph mode) said control circuits including a time standard, dividing means and storage registers adapted to provide signals pertaining to each mode, decoder-driver means and a plurality of control switches, there being provided an indicator comprising signal emitting means coupled to the control circuits in a manner to indicate by a first output state that the chronograph mode is disconnected and chronograph registers reset, by a second output state that counting in the chronograph mode is taking place and by a third output state that counting in the chronograph mode is stopped and that the registers remain set, the second and third output states being independent of which mode is being displayed.

DETAILED DESCRIPTION OF THE INVENTION

Figure 1:
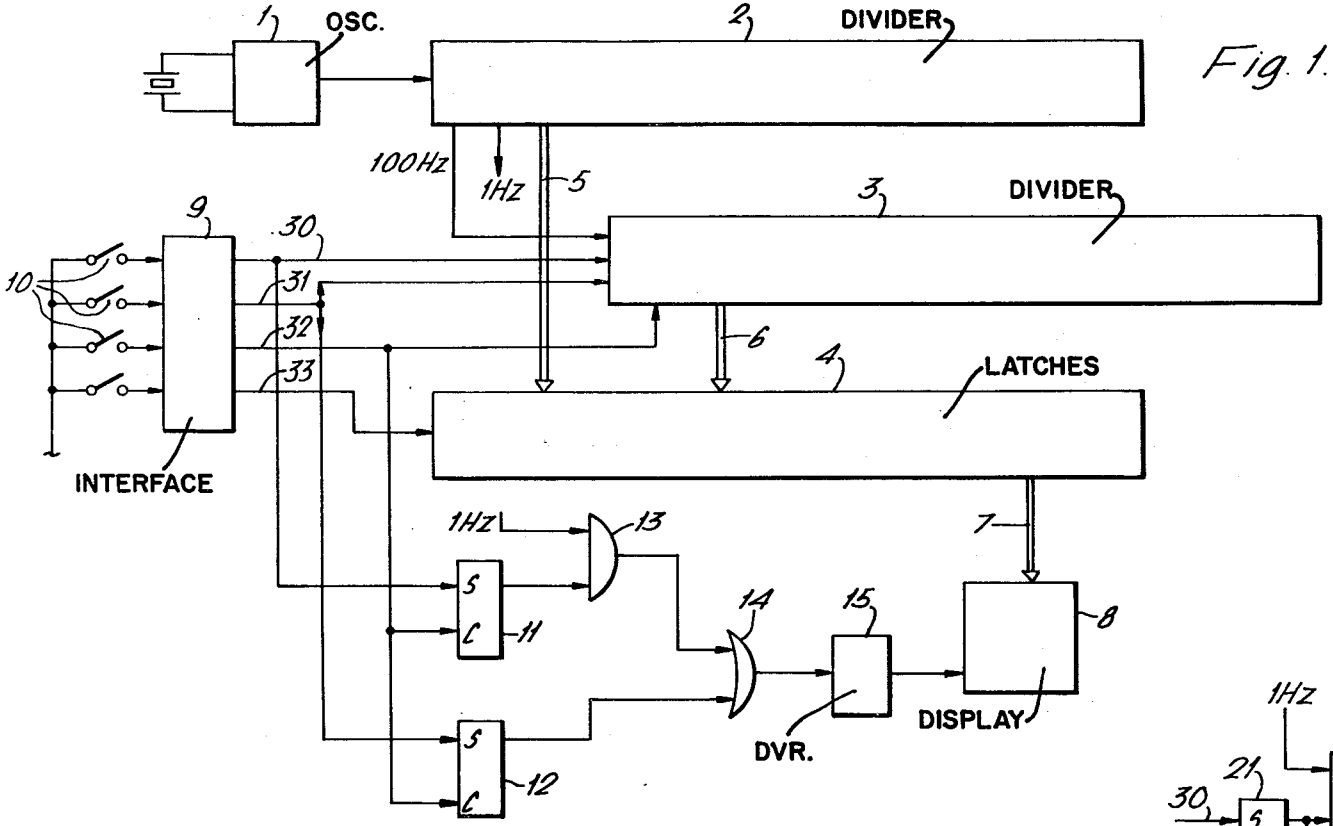
FIG. 1 is a block diagram of the timepiece of the present invention provided with one form of special control circuit.

In FIG. 1 there is shown a block diagram of the circuits of the invention including the further blocks needed whereby the timepiece performs chronograph functions as well as timekeeping functions. Thus, 1 represents an oscillator which may preferably be controlled by a quartz resonator as time standard and the output of which is applied to a frequency divider 2. Frequency divider 2 provides outputs on cable 5 representative of the time of day and may, for instance, provide outputs representing seconds, tens of seconds, minutes, tens of minutes, hours up to 24 hours, days and days of the week. Cable 5 conducts these various outputs from frequency divider 2 to a decoder-driver and latching circuit 4 and the output from decoder-driver 4 is applied over cable 7 to display 8 which may take the form, for instance, of a digital type display using liquid crystals, light emitting diodes, or other elements permitting non-mechanical display of data in digital from.

A further output from frequency divider 2 is in the form of a 100 Hz signal which is applied to a further frequency divider 3. Frequency divider 3 is in effect a chronograph divider and register and may provide signals representing hundredths of a second, tenths of a second, seconds, tens of seconds, minutes, tens of minutes and hours on its output cable 6 to the decoder-driver and latching circuits 4. These signals in turn may be switched to display 8 when the proper control signals are applied to the latch 4.

The circuits described up until now are all well-known in the chronograph timepiece art and it is thought unnecessary to provide further details thereof. Reference may be had, for example, to U.S. Pat. application No. 673,328 assigned to the Applicant of the present Application insofar as details of a chronograph type divider circuit might be required.

Consider next the special control circuits. Block 9 on FIG. 1 may comprise an interface between a set of control switches 10 and the various circuits to which control signals are to be applied. In the example as shown, line 30 may provide a chronograph start signal, line 31 a chronograph stop signal, line 32 a register reset signal and line 33 a display mode signal. Thus actuation of the appropriate switch to produce a signal on line 30 will cause the 100 Hz output signal from divider circuit 2 to be applied to chronograph dividers and registers 3. At the same time the output signal on line 30 will be applied to set a bistable flip-flop 11.

The set output of flip-flop 11 is gated with a 1 Hz signal from frequency divider 2 in AND-gate 13, the output of which is transmitted through OR-gate 14 to a driver circuit 15 and thence to display 8. It will be appreciated in this instance that the output applied to display 8 via driver 15 will be in the form of an intermittent signal having a 1 Hz rate. This signal may then be applied to cause a blinking output from the display or may be alternately applied to a separate element on the display which will be caused to blink intermittently. Alternately, it can be envisaged that the output could be also applied to an audible type display or alarm, should such be preferred.

Should now the user arrive at the end of the event to be timed he may actuate the stop switch which will produce an output on line 31. This will terminate the counting taking place in divider and registers 3 and at the same time will apply a set signal to bistable flip-flop 12. The set output of flip-flop 12 is applied through OR-gate 14 to driver circuit 15 and as in the previous case to display 8. It will thus be obvious that when the stop switch has been actuated at the end of an event being timed a steady signal will be applied via flip-flop 12, OR-gate 14 and driver circuit 15 to display 8 and this steady signal will actuate the display indicator in a steady manner and will override the intermittent signal which continues to be produced via flip-flop 11 and AND-gate 13. It will be likewise evident that the intermittent or steady indicator signals may continue regardless of whether the display is operating in the timekeeping or chronograph mode.

Actuation, however, of a switch to produce a signal on reset line 32 will reset all registers in chronograph divider and register circuits 3 and as well will reset bistable flip-flops 11 and 12. Thus, the special indicator signal will now be extinguished.

When the appropriate switch 10 is actuated to produce a signal on line 33 this will be applied to the latch decoder-driver circuits 4 in a manner such that either the chronograph mode or the timekeeping mode will be displayed at the choice of the user. The indicator signals from the control circuits just described are, however, independent of the mode being displayed.

A problem which may arise during use of the circuit arrangement as shown in FIG. 1 comes about through the fact that shifting from the chronograph stop condition to the chronograph start condition without resetting will leave the indicator with a steady signal output. Thus, it will be evident that once the stop signal has been applied via line 31, as shown a steady signal will appear on the display and this can only be extinguished through application of a reset signal on line 32. This disadvantage may be inconvenient should split timing and lap timing be required. In order to overcome this problem the circuit as shown in FIG. 2 has been devised and this, while retaining the advantages of the arrangement FIG. 1, overcomes the above-mentioned difficulty.

As in FIG. 1 lines 30, 31 and 32 represent start, stop and reset signals obtained from the interface and logical control block 9. Signal lines 30 and 31 are applied respectively to the set and clear inputs of a bistable device 21. The SET output of device 21 is applied to the NAND-gate 22 to which is also applied a 1 Hz signal from the frequency divider 2. The SET output from device 21 may further be applied to an inverter 24 and from thence to a NAND-gate 25 and to one input of a bistable arrangement provided by a pair of cross-coupled NAND-gates 26 and 27. The other input to the bistable pair 26 and 27 is obtained from the output of NAND-gate 25 and is applied to the input of NAND-gate 27. The output from the bistable pair 26, 27 is taken from NAND-gate 26 and is applied to the input of NAND-gate 23 to which is also applied the output of NAND-gate 22. The output of NAND-gate 23 in turn is passed through inverter 28 and thence to the indicator element here identified as 29, but which may be incorporated in various forms into display 8.

Figure 2:
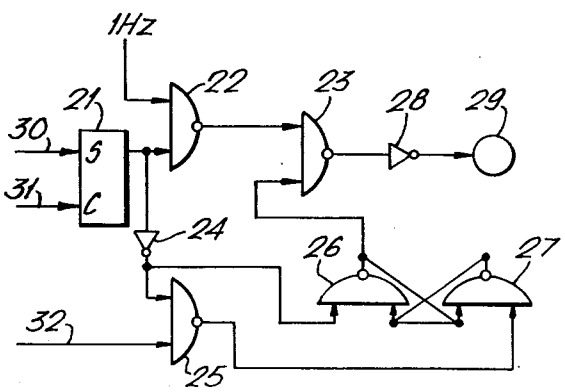
FIG. 2 is a variation showing an improved or preferred version of the special control circuit only of the timepiece as shown in FIG. 1.

In operation the control circuit of FIG. 2 will be seen to provide its switching possibilities through means of the output obtained from element 21. Thus, when the start signal is applied via line 30 the output from element 21 provides an enable signal to NAND-gate 22. Thus, an intermittent 1 Hz output will be obtained from NAND-gate 22. The same output from element 21 is inverted in inverter 24 and blocks NAND-gate 25 as well as NAND-gate 26.

Since normally the reset input on line 32 is at a low level the output from NAND-gate 25 will be at a high level. If, however, we assume initially that a reset signal has been applied on line 32 while element 21 was cleared then it follows that a low level output will have appeared on the output from NAND-gate 25 and this in turn will have established the high level signal from NAND-gate 27 which will be combined with the high going signal from element 24 via NAND-gate 26 to produce a low level output therefrom and to establish the initial conditions wherein NAND-gate 23 is blocked.

Subsequently, when the chronograph start signal is applied to line 30 corresponding to the start of the chronograph counting, an enabling signal will appear on the output of element 21 which will enable an intermittent output from NAND-gate 22. The same enabling high output signal from bistable device 21 on being applied to inverter 24 will bring about a change in the situation insofar as concerns NAND-gate 26 and 27 as connected to form the bistable device previously referred to. Thus, the low going signal now coming from inverter 24 will establish a high going output from NAND-gate 26 which when combined with the high going output from NAND-gate 25 in NAND-gate 27 will have the effect of setting the bistable device whereby a high going enabling signal is now applied to NAND-gate 23. The intermittent signals from NAND-gate 22 are accordingly transmitted via inverter 28 to the display device 29.

Should now the stop signal appear on line 31 the SET output from the bistable means 21 will become a low level signal. This as applied to NAND-gate 22 produces a steady high level output therefrom whereby NAND-gate 23 now produces a steady low level output which is inverted in inverter 28 to provide a steady signal to the display indicator 29.

It will be apparent that the user can alternately apply the start signal via line 30 and the stop signal via line 31, each of these signals merely serving to change the condition of the output from device 21 whereby the signal thereafter appearing on the indicator 29 will be either intermittent or steady depending upon whether the chronograph is stopped or in the process of counting. This as in the previous example is independent of whether or not the chronograph mode is actually being displayed.

Should now a reset signal be applied on line 32 this will, as in the previous instance, serve to clear the registers in the chronograph counting circuits and registers 3 and at the same time will cause a low level output from NAND-gate 25 in the control circuit FIG. 2. This low level will in turn provide a high level output from NAND-gate 27 which in the presence of a high level signal from inverter 24 will have the effect of resetting bistable pair 26–27 whereby a low level blocking signal thereafter applies to NAND-gate 23. The system will now be completely reset and should the chronograph display mode be engaged this will show up zeros on the display indicating that the chronograph registers have been reset. No signal will appear on the indicator 29 and it will thus be apparent that the circuit has been restored to initial conditions.

Although two circuits have been shown for accomplishing the purpose of the present invention it should be apparent that other circuits are possible in accordance with the principles as hereinbefore taught.

What is claimed is:

1. An electronic timepiece having control circuits arranged to drive a digital display so as to display selectively the passage of time (timepiece mode) or an interval of time (chronograph mode) said control circuits including a time standard, dividing means and storage registers adapted to provide signals pertaining to each mode, decoder-driver means and a plurality of control switches, there being provided an indicator comprising signal emitting means coupled to the control circuits in a manner to indicate by a first output state that the chronograph mode is disconnected and chronograph registers reset, by a second output state that counting in the chronograph mode is taking place and by a third output state that counting in the chronograph mode is stopped and that the registers remain set, the second and third output states being independent of which mode is being displayed.

2. An electronic timepiece as set forth in claim 1 wherein the signal emitting means is coupled to a chronograph start switch, a chronograph stop switch and the dividing means in a manner such that actuation of one of said switches provides an intermittent control signal to the signal emitting means and actuation of the other switch provides a steady control signal to the signal emitting means.

3. An electronic timepiece as set forth in claim 2 wherein the chronograph start switch is coupled to a gate which is enabled by actuation of said start switch to transmit an intermittent signal from the dividing means to the signal emitting means and the chronograph stop switch is arranged so as to provide on actuation thereof a steady signal to the signal emitting means.

4. An electronic timepiece as set forth in claim 1 wherein the signal emitting means comprises an optical indicator of the same nature as the digital display.

5. An electronic timepiece as set forth in claim 4 wherein the optical indicator is in the form of a star or asterisk which remains invisible in the absence of control signals.

6. An electronic timepiece as set forth in claim 1 wherein the control switches include a chronograph start switch arranged to set a first bistable means and a chronograph stop switch arranged to set a second bistable means the output from the first bistable means being applied to a first gating circuit along with a signal from the dividing means and the output from the second bistable means being applied to a second gating circuit along with the output from the first gating circuit, the output from the second gating circuit providing control signals to the signal emitting means.

7. An electronic timepiece as set forth in claim 6 wherein the control switches further include a chronograph reset switch arranged to provide a reset signal to said first and second bistable means whereby actuation of the chronograph start switch provides an intermittent control signal to the signal emitting means, actuation of the chronograph stop switch provides a steady control signal to the signal emitting means and actuation of the chronograph reset switch cuts off signals to the signal emitting means.

8. An electronic timepiece as set forth in claim 7 wherein the signal emitting means comprises an optical indicator adapted to provide a blinking output when the chronograph mode is counting, and a steady output when the chronograph mode is stopped independently of which mode is being displayed.

9. An electronic timepiece as set forth in claim 1 wherein the control switches include a mode switch arranged to couple either the timepiece mode or the chronograph mode to the display, said mode switch being independent of the other control switches.

10. An electronic timepiece as set forth in claim 1 wherein the control switches include a chronograph start switch and a chronograph stop switch coupled respectively to set and clear inputs of a bistable means, the output from the bistable means being gated with the signal from the dividing means and the complement of the output from the bistable means being applied to bistable storage means whereby a set output from the bistable means provides an intermittent signal to the indicator and a clear output from the bistable means provides a steady signal to the indicator.

11. An electronic timepiece as set forth in claim 10 wherein the control switches further include a reset switch arranged to apply a clearing signal to the bistable storage means, the clear output of said bistable storage means being adapted to remove all actuating signals from said indicator.

* * * * *